US010272580B2

(12) United States Patent
Griffin et al.

(10) Patent No.: US 10,272,580 B2
(45) Date of Patent: Apr. 30, 2019

(54) PIVOTING RAZORS

(71) Applicant: SHAVELOGIC, INC., Dallas, TX (US)

(72) Inventors: John W. Griffin, Moultonborough, NH (US); Craig A. Provost, Boston, MA (US); William E. Tucker, Attleboro, MA (US)

(73) Assignee: SHAVELOGIC, INC., Dallas, TX (US)

( * ) Notice: Subject to any disclaimer, the term of this patent is extended or adjusted under 35 U.S.C. 154(b) by 0 days.

(21) Appl. No.: 15/805,486

(22) Filed: Nov. 7, 2017

(65) Prior Publication Data

US 2018/0071933 A1 Mar. 15, 2018

Related U.S. Application Data

(63) Continuation of application No. 15/044,028, filed on Feb. 15, 2016, now Pat. No. 9,844,887, which is a continuation of application No. 13/929,644, filed on Jun. 27, 2013, now Pat. No. 9,283,685.

(60) Provisional application No. 61/675,930, filed on Jul. 26, 2012.

(51) Int. Cl.

| | |
|---|---|
| ***B26B 21/52*** | (2006.01) |
| ***B26B 21/22*** | (2006.01) |
| ***B26B 21/40*** | (2006.01) |

(52) U.S. Cl.

CPC ..... *B26B 21/521* (2013.01); *B26B 21/225* (2013.01); *B26B 21/4081* (2013.01); *Y10T 83/04* (2015.04)

(58) Field of Classification Search

CPC . B26B 21/521; B26B 21/4081; B26B 21/225; Y10T 83/04

See application file for complete search history.

(56) References Cited

U.S. PATENT DOCUMENTS

| | | | | | |
|---|---|---|---|---|---|
| 996,879 | A | * | 7/1911 | Odell | B26B 21/18 30/48 |
| 1,015,575 | A | * | 1/1912 | Meyer | B26B 21/225 30/346.55 |
| 1,074,615 | A | * | 10/1913 | Folmer | A47D 15/006 297/464 |
| 3,593,416 | A | * | 7/1971 | Edson | B26B 21/14 30/50 |
| 3,709,517 | A | * | 1/1973 | Wossner | B60G 17/033 280/104 |
| 3,768,348 | A | * | 10/1973 | Braun | B26B 19/16 83/13 |
| 3,950,848 | A | | 4/1976 | Goldstein | |
| 4,094,063 | A | * | 6/1978 | Trotta | B26B 21/521 30/47 |
| 4,403,414 | A | | 9/1983 | Kiraly | |
| 4,475,286 | A | * | 10/1984 | Saito | B26B 21/225 30/50 |

(Continued)

*Primary Examiner* — Sean M Michalski

(74) *Attorney, Agent, or Firm* — Leber IP Law; Celia H. Leber

(57) ABSTRACT

Replaceable shaving assemblies are disclosed that include a blade unit, an interface element configured to removably connect the blade unit to a handle, on which the blade unit is pivotably mounted, and an elastomeric element disposed between the blade unit and interface element. Shaving systems including such shaving assemblies are also disclosed, as are methods of using such shaving systems.

20 Claims, 19 Drawing Sheets

(56) References Cited

U.S. PATENT DOCUMENTS 4,774,765 A * 10/1988 Ferraro ..... B26B 21/227 30/50
4,785,534 A * 11/1988 Lazarchik ..... B26B 21/225 30/50
4,834,760 A * 5/1989 Richter, Jr. ..... A61F 2/588 294/104
4,838,564 A * 6/1989 Jarvis ..... A63C 17/064 280/11.225
4,850,518 A * 7/1989 Salmon ..... B62D 43/04 224/42.23
5,029,391 A 7/1991 Althaus
5,074,042 A * 12/1991 Althaus ..... B26B 21/227 30/50
5,168,628 A * 12/1992 Mock ..... B05B 11/0005 30/125
5,219,468 A * 6/1993 Olson ..... B01D 29/356 210/769
5,369,885 A * 12/1994 Ferraro ..... B26B 21/227 30/41
5,402,574 A * 4/1995 Milner ..... B26B 21/227 30/41.5
5,466,901 A * 11/1995 Mochizuki ..... H01H 3/125 200/344
5,551,153 A * 9/1996 Simms ..... B26B 21/227 30/346.59
5,551,717 A * 9/1996 De Courcey Milne ..... A63C 17/01 280/11.27
5,645,603 A 7/1997 Peters
5,678,316 A * 10/1997 Althaus ..... B26B 21/522 30/340
5,771,591 A * 6/1998 Armbruster ..... B26B 21/52 30/340
5,794,342 A * 8/1998 Davey ..... B26B 21/38 30/43.92
5,855,071 A 1/1999 Apprille et al.
6,014,918 A * 1/2000 Orloff ..... B26B 21/405 30/34.05
6,122,826 A * 9/2000 Coffin ..... B26B 21/521 30/527
6,161,287 A * 12/2000 Swanson ..... B26B 21/225 30/47
6,223,442 B1 * 5/2001 Pina ..... B26B 21/225 30/50
6,311,400 B1 * 11/2001 Hawes ..... B26B 21/225 30/50
6,357,118 B1 * 3/2002 Eichhorn ..... B26B 19/048 30/43.92
6,502,318 B1 * 1/2003 Gilder ..... B26B 21/225 30/50
6,615,498 B1 9/2003 King
6,880,253 B1 4/2005 Gyllerstrom
6,973,730 B2 12/2005 Tomassetti
6,990,740 B2 1/2006 Follo
7,028,405 B2 4/2006 Paas et al.
7,086,160 B2 8/2006 Coffin
7,100,284 B2 9/2006 King
7,103,976 B2 9/2006 Pennella
7,152,512 B1 12/2006 Prochaska
7,200,942 B2 4/2007 Richard
7,461,458 B2 12/2008 Peyser
7,526,869 B2 5/2009 Blatter
7,574,809 B2 8/2009 Follo
7,669,511 B2 3/2010 King
7,797,834 B2 9/2010 Steunenberg
7,802,368 B2 9/2010 Coffin et al.
7,877,879 B2 2/2011 Nakasuka
8,033,023 B2 10/2011 Johnson
8,096,054 B2 1/2012 Denkert
8,166,661 B2 5/2012 King
8,205,343 B2 6/2012 Winter et al.
8,205,344 B2 6/2012 Stevens
8,273,205 B2 9/2012 Murgida
8,307,552 B1 11/2012 Droulliard
8,484,852 B2 7/2013 King
8,499,459 B2 8/2013 Efthimiadis et al.
8,590,162 B2 11/2013 Park et al.
8,640,342 B2 2/2014 Murgida
8,732,955 B2 5/2014 Howell et al.
8,769,825 B2 7/2014 Howell et al.
8,789,282 B2 7/2014 Wilson et al.
8,793,880 B2 8/2014 Taub et al.
8,844,145 B2 9/2014 Psimadas et al.
9,283,685 B2 3/2016 Griffin
2002/0059729 A1 * 5/2002 Ikuta ..... B26B 19/04 30/43.91
2002/0138992 A1 * 10/2002 Richard ..... B26B 21/225 30/527
2002/0157255 A1 * 10/2002 Coffin ..... B26B 21/44 30/41
2003/0154603 A1 * 8/2003 Guimont ..... B26B 21/44 30/34.05
2003/0200659 A1 * 10/2003 Coffin ..... B26B 21/227 30/47
2003/0200660 A1 * 10/2003 Pennella ..... B26B 21/222 30/47
2003/0205858 A1 11/2003 Hall
2004/0010918 A1 * 1/2004 Orloff ..... A45D 27/04 30/41
2004/0177519 A1 * 9/2004 Tomassetti ..... B26B 21/225 30/527
2005/0207837 A1 * 9/2005 Kosh ..... A44B 11/2592 403/327
2005/0278954 A1 * 12/2005 Orloff ..... B26B 21/227 30/32
2006/0037197 A1 * 2/2006 Hawes ..... B26B 19/3806 30/45
2006/0080837 A1 * 4/2006 Johnson ..... B26B 21/44 30/50
2006/0080838 A1 4/2006 Johnson
2006/0283025 A1 * 12/2006 Follo ..... B26B 21/225 30/527
2007/0151106 A1 * 7/2007 Steunenberg ..... B26B 19/048 30/50
2007/0204932 A1 9/2007 Freed
2007/0289139 A1 * 12/2007 Peyser ..... B26B 21/225 30/47
2008/0155831 A1 * 7/2008 Royle ..... B26B 21/222 30/34.1
2008/0189964 A1 8/2008 Bozikis
2008/0196251 A1 8/2008 Royle
2009/0000126 A1 * 1/2009 Kraus ..... B26B 19/046 30/34.1
2010/0011583 A1 * 1/2010 Efthimiadis ..... B26B 21/222 30/34.1
2010/0043242 A1 2/2010 Stevens
2010/0083505 A1 * 4/2010 Royle ..... B26B 21/225 30/50
2011/0138586 A1 * 6/2011 Gompert ..... F16B 45/02 24/599.4
2011/0192031 A1 * 8/2011 Coresh ..... B26B 21/22 30/34.2
2011/0247217 A1 10/2011 Johnson et al.
2012/0060382 A1 * 3/2012 Beugels ..... B26B 19/048 30/527
2012/0073554 A1 * 3/2012 Victor ..... F41A 19/52 124/16
2012/0124840 A1 5/2012 Iaccarino et al.
2012/0210586 A1 8/2012 Lelieveld et al.
2012/0297625 A1 11/2012 Madden
2013/0025578 A1 1/2013 Jones
2013/0081289 A1 4/2013 Wain et al.
2013/0174821 A1 7/2013 Jones
2014/0083265 A1 3/2014 Provost et al.
2014/0109735 A1 4/2014 Shepperson
2014/0165800 A1 6/2014 Griffin
2015/0158192 A1 6/2015 Tucker
2015/0174776 A1 6/2015 Hawes
2015/0190935 A1 7/2015 Griffin
2015/0190936 A1 7/2015 Griffin

(56) References Cited

U.S. PATENT DOCUMENTS

| | | | |
|---|---|---|---|
| 2015/0290819 | A1 | 10/2015 | Giannopoulos |
| 2015/0306777 | A1 | 10/2015 | Georgakis |
| 2015/0314465 | A1 | 11/2015 | Giannopoulos |
| 2015/0314466 | A1 | 11/2015 | Papadopoulos-Papageorgis |
| 2015/0321366 | A1 | 11/2015 | Papadopoulos-Papageorgis |

* cited by examiner

PIVOTING RAZORS

RELATED APPLICATIONS

This application is a continuation application of U.S. patent application Ser. No. 15/044,028, filed Feb. 15, 2016, which is a continuation of U.S. patent application Ser. No. 13/929,644, filed Jun. 27, 2013, now U.S. Pat. No. 9,283,685, granted on Mar. 15, 2016, which claims priority of U.S. Provisional Application Ser. No. 61/675,930, filed on Jul. 26, 2012. The complete disclosure of these applications are hereby incorporated by reference herein.

BACKGROUND

The invention relates to shaving systems having handles and replaceable blade units. Shaving systems often consist of a handle and a replaceable blade unit in which one or more blades are mounted in a plastic housing. After the blades in a blade unit have become dull from use, the blade unit is discarded, and replaced on the handle with a new blade unit. Such systems often include a pivoting attachment between the blade unit and handle, which includes a pusher and follower configured to provide resistance during shaving and return the blade unit to a "rest" position when it is not in contact with the user's skin.

SUMMARY

Embodiments of the present invention generally provide a reusable shaving system including a replaceable shaving assembly having a pivoting blade unit, and a reusable handle on which the shaving assembly is removably mounted.

In one aspect, the invention features a replaceable shaving assembly that includes a blade unit; a handle interface element configured to removably connect the blade unit to a handle, on which the blade unit is pivotably mounted; and an elastomeric element disposed between the blade unit and handle interface element.

Some implementations include one or more of the following features.

The handle interface element may include one or more protrusions, and the elastomeric element comprises at least one loop configured to receive the protrusion(s). For example, the handle interface element may include a pair of fingers extending in opposite directions, and the elastomeric element may include a pair of loops that are configured to receive the fingers. The loops may extend from the blade unit, or alternatively may be provided by mounting the elastomeric element onto the blade unit. For example, the elastomeric element may be provided on a blade unit interface element that clips onto the blade unit. In some cases, the blade unit includes an elastomeric guard and the loops are formed integrally with the guard. For example, the guard can include a pair of openings defining elongated elastomeric portions that initially lie flat against the cartridge, and, when stretched during assembly, form the loops.

In some preferred implementations, the elastomeric element is configured to bias the blade unit towards a rest position with respect to a pivot axis that is generally parallel to a long axis of the blade unit.

In another aspect, the invention features a shaving system that includes a handle having a distal end and a proximal end; and a replaceable shaving assembly that includes a blade unit, an interface element configured to removably connect the blade unit to a handle, on which the blade unit is pivotably mounted, and an elastomeric element disposed between the blade unit and interface element.

The shaving system may include any of the features disclosed above or elsewhere herein.

In yet a further aspect, the invention features a method of shaving comprising contacting the skin with the blade unit of a shaving system comprising a handle having a distal end and a proximal end, and a replaceable shaving assembly that includes a blade unit, an interface element configured to removably connect the blade unit to a handle, on which the blade unit is pivotably mounted, and an elastomeric element disposed between the blade unit and interface element.

Advantageously, in some implementations the elastomeric elements of the shaving systems disclosed herein eliminate the need for a "pusher/follower" razor construction to provide a force to supply resistance during shaving and return the blade unit to a "rest" portion when not in contact with the user's skin.

DETAILED DESCRIPTION

The present disclosure relates generally to consumer products and, in particular, to shaving systems with interchangeable blade units. In one embodiment, the present disclosure features a reusable consumer product system having an interchangeable pivoting blade unit, which includes an elastomeric return element.

Figure 1:
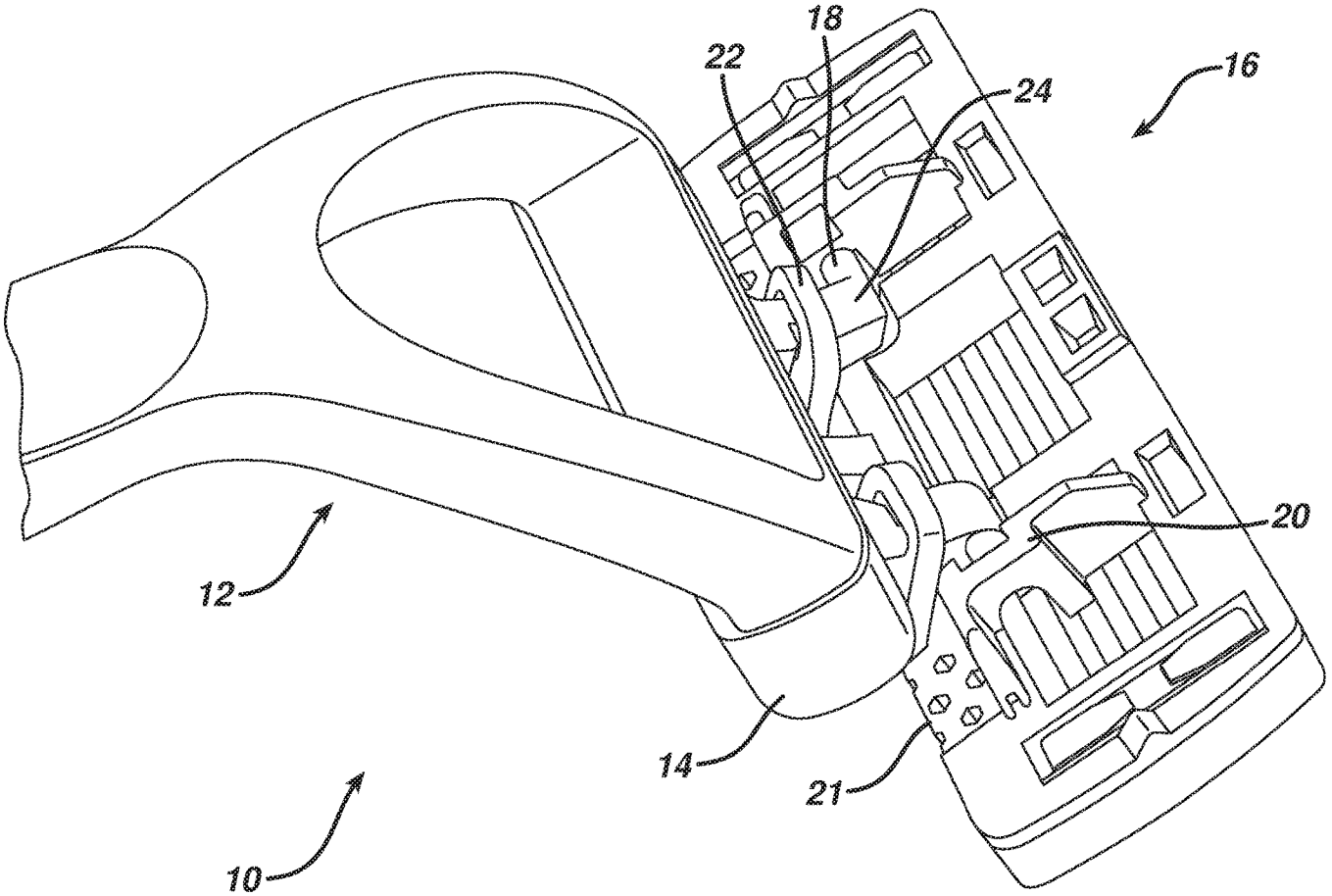
FIG. 1 is a perspective view of the shaving system according to one embodiment of the invention.

FIG. 1 shows a shaving system 10 that includes a handle 12, handle interface element 14, and blade unit 16. Blade unit 16 is pivotably mounted on interface element 14 by the positioning of a pair of fingers 18, which extend from the interface element, in receiving bores 20 which may be molded integrally with the blade unit 16 or part of a separate connector snapped onto the blade unit. Pivoting of the blade unit is about an axis that is generally parallel to the long axis of the blade unit and is generally positioned to allow the blade unit to follow the contours of a user's skin during shaving. Generally, the handle interface element 14 and blade unit 16 are sold to the consumer as an integrated replaceable shaving assembly.

Figure 2:
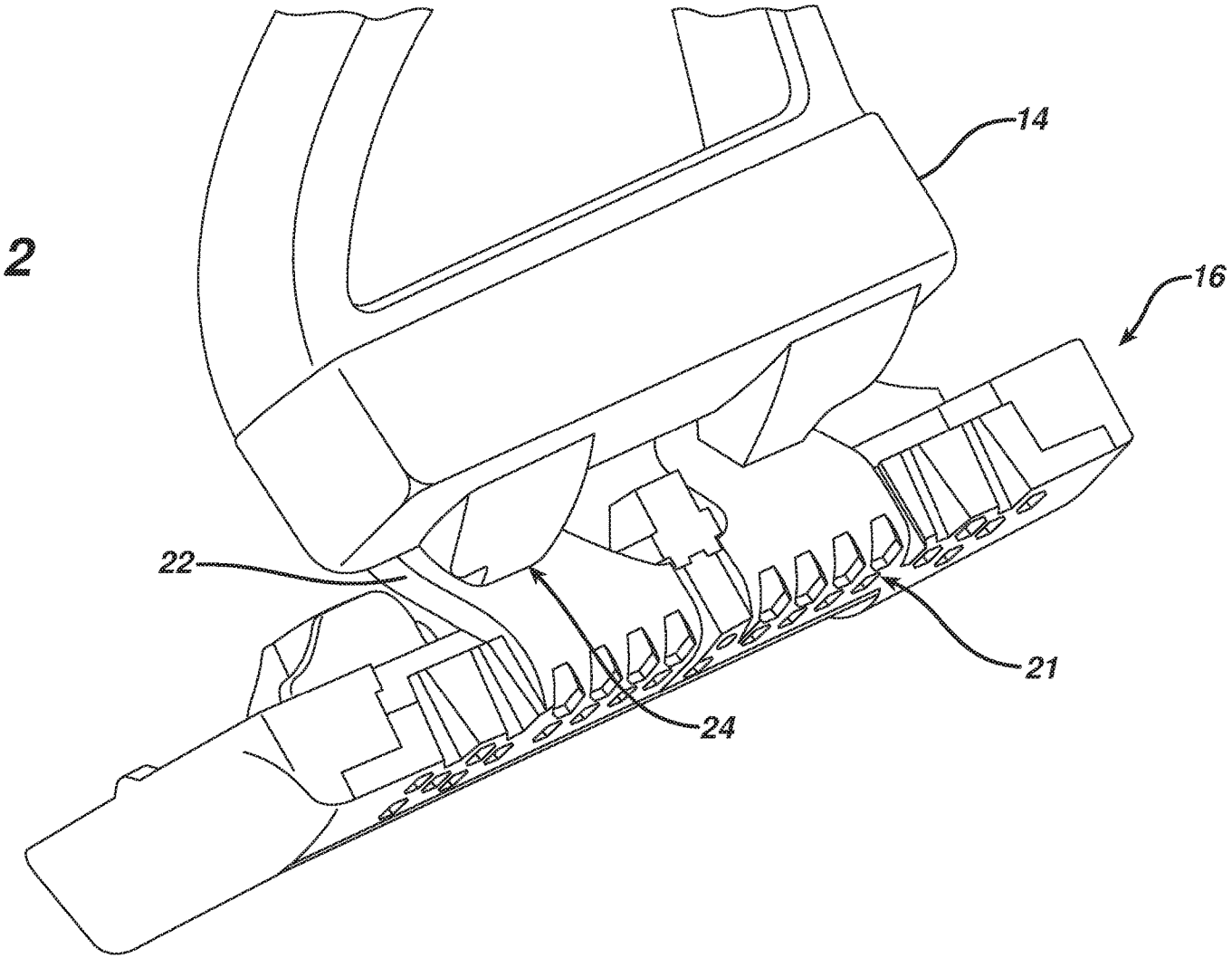
FIG. 2 is a perspective view of the shaving system of FIG. 1 viewed from a different angle.

A pair of elastomeric loops 22, extending from a guard portion 21 of the blade unit 16, are positioned around the arms 24 from which fingers 18 extend. The elastomeric material of these loops is put under tension as the blade unit pivots during shaving. This tension provides resistance during shaving, limiting the free pivoting of the blade unit about the pivot axis described above, and providing a return force that biases the blade unit towards its rest position. Thus, the elastomeric loops provide the resistance and return that are typically provided by a pusher/follower assembly. The loops may be integrally molded with the guard, as shown in the figures (see, e.g., FIG. 2), may be comolded with the guard (e.g., the guard and loops may be of two different materials that are molded together), or may be attached to the guard.

The elastomeric loops can be formed, for example, from synthetic or natural rubber materials. Preferably, the elastomeric loops are formed from the same material as the guard. Suitable guard materials are well known in the shaving system art, and include, for example, polyether-based thermoplastic elastomers (TPEs) available from Kraiburg HTP, polyether-based thermoplastic vulcanizate elastomer (TPVs) available from GLS PolyOne Corporation under the tradename Santoprene™. The elastomeric material is selected to provide a desired degree of restoring force and durability.

Preferably, the loops are positioned relatively close to the pivot point of the blade unit, so as to minimize strain on the elastomer and thus extend the shelf life and use life of the shaving assembly.

Figure 3:
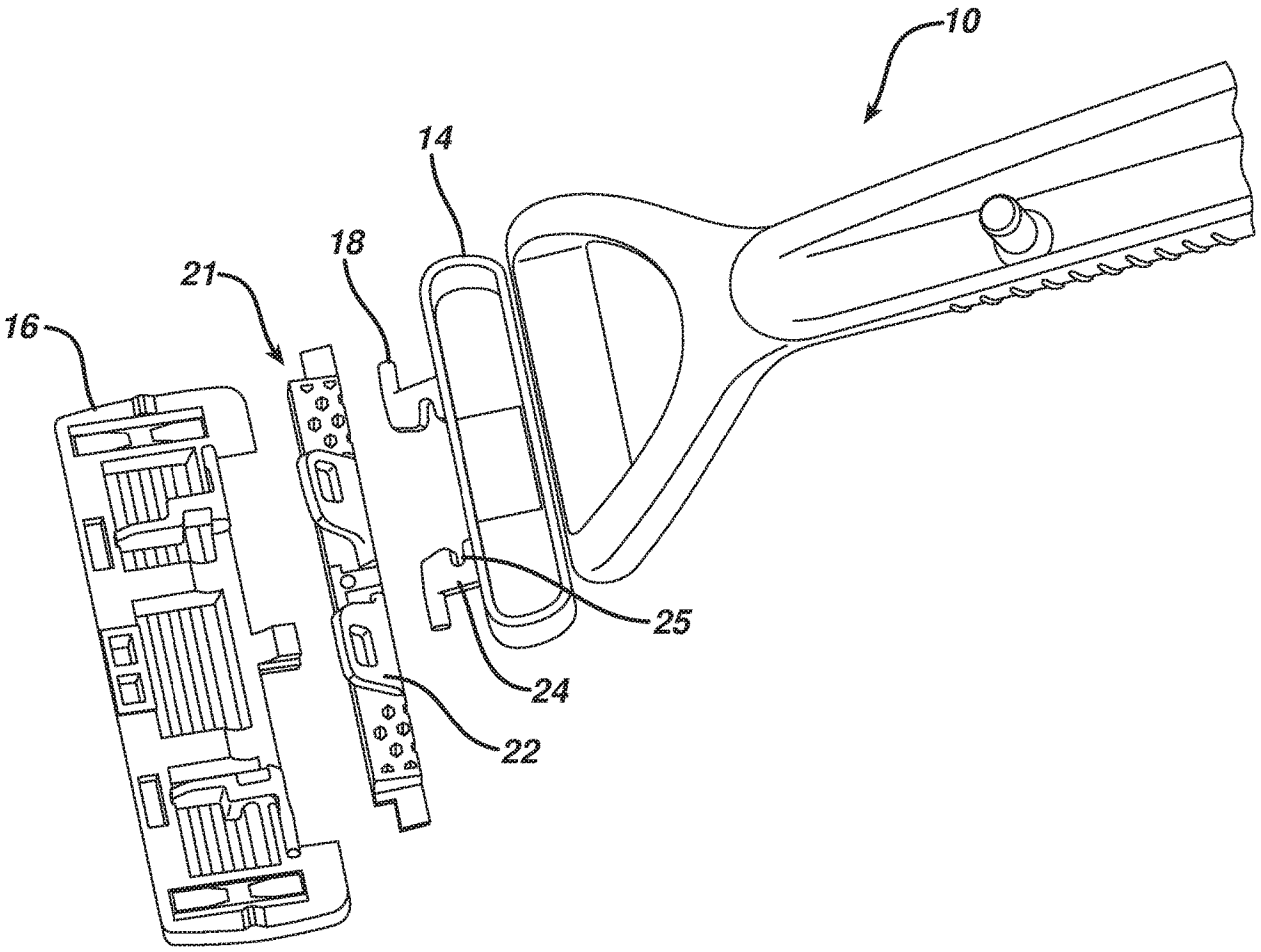
FIG. 3 is an exploded view of the shaving system of FIG. 1.

An exploded view of the shaving system is shown in FIG. 3, illustrating the guard/elastomeric loops separated from the blade unit housing and more clearly showing the arms and fingers of the interface element. In this view, indentations 25 in arms 24 are clearly visible. These indentations serve to hold the loops 22 securely in place after they have been threaded over the arms.

Figure 4:
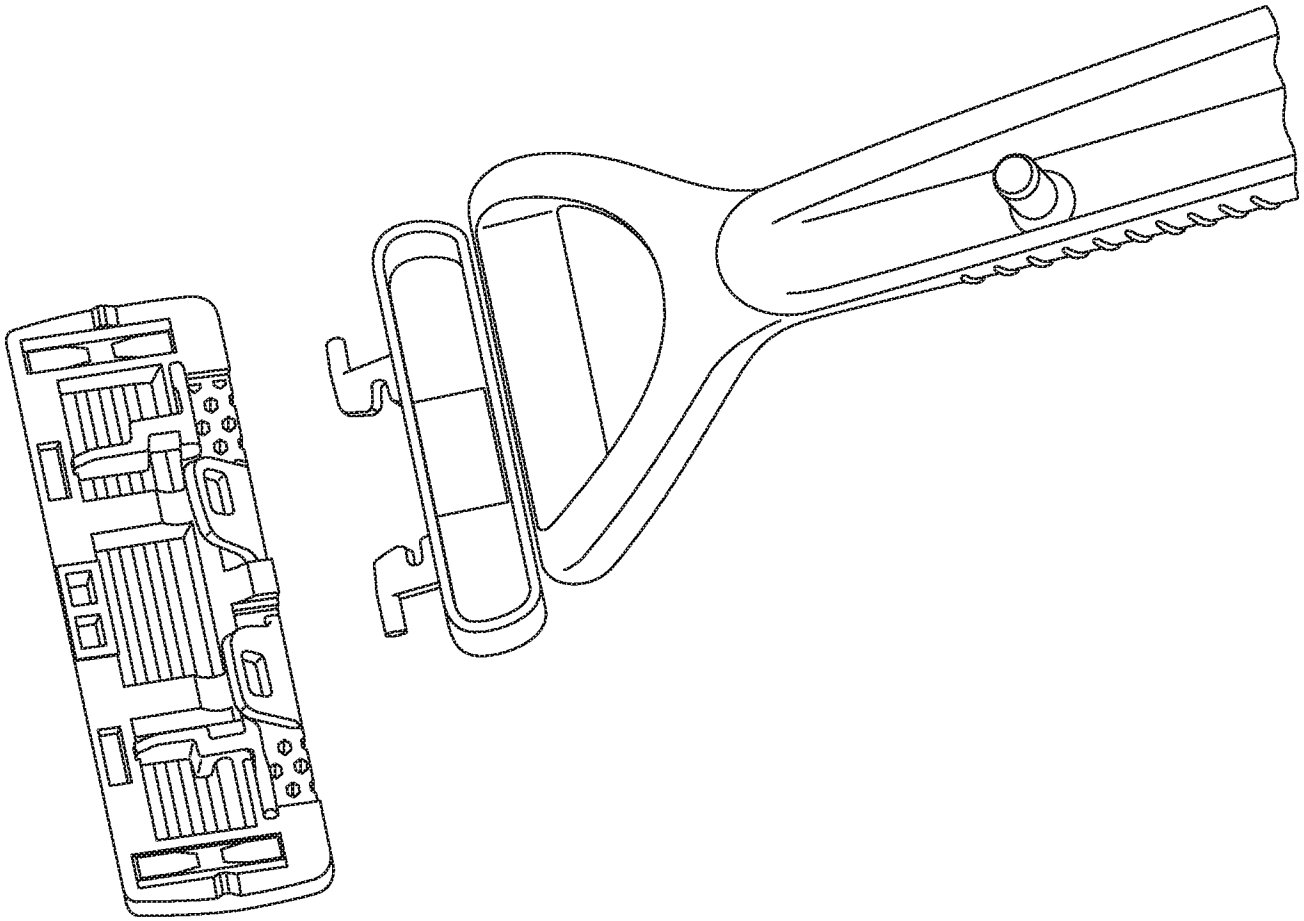
FIG. 4 is a partially exploded view of the shaving system of FIG. 1 with the elastomeric portion assembled onto the blade unit.
Figure 5:
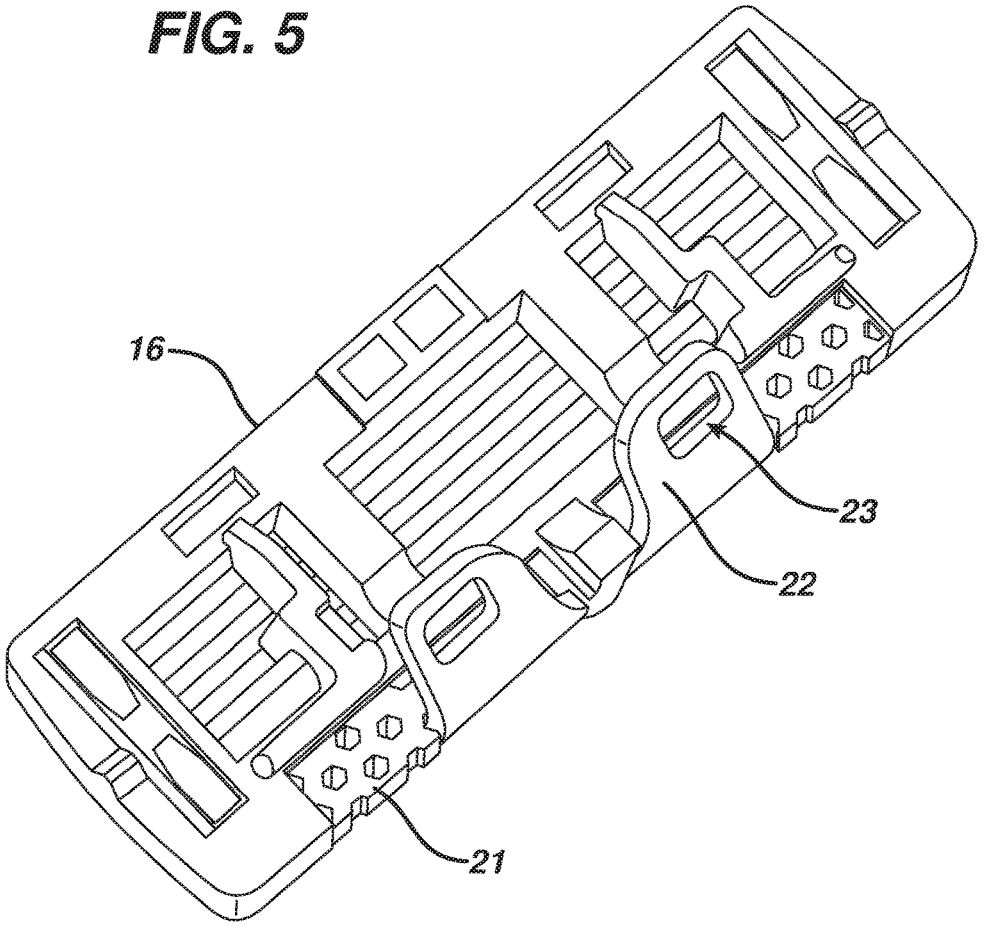
FIG. 5 is a perspective view of the blade unit with the elastomeric portion attached.
Figure 6:
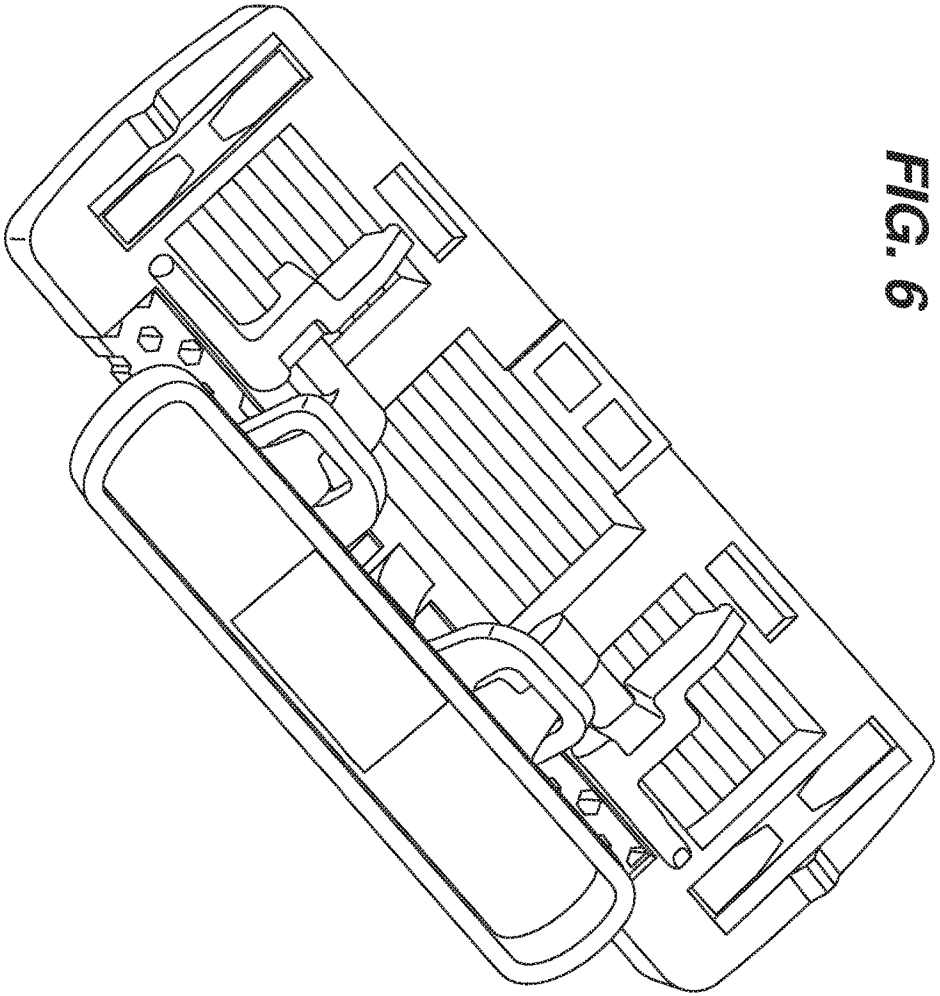
FIG. 6 is a perspective view of a replaceable shaving assembly including the blade unit, elastomeric portion, and interface element.
Figure 7:
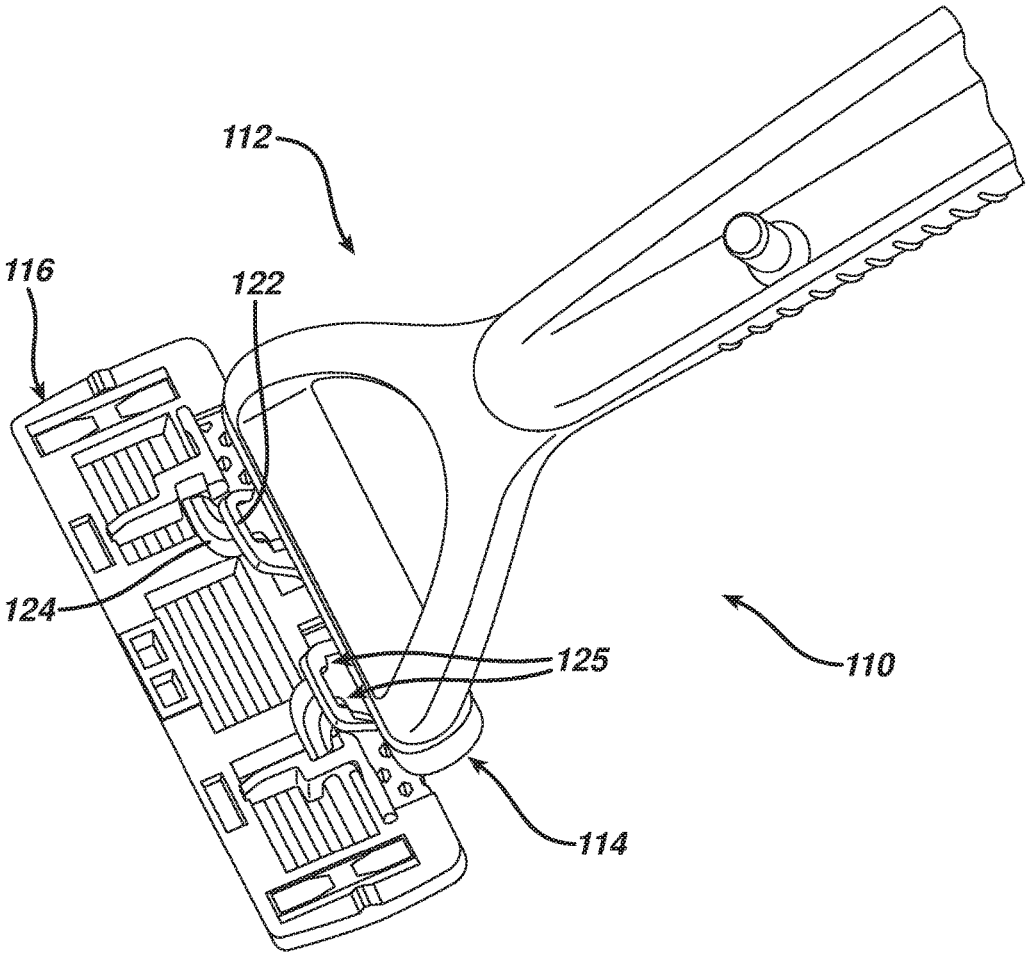
FIG. 7 is a perspective view of a shaving system according to an alternate embodiment of the invention.
Figure 8:
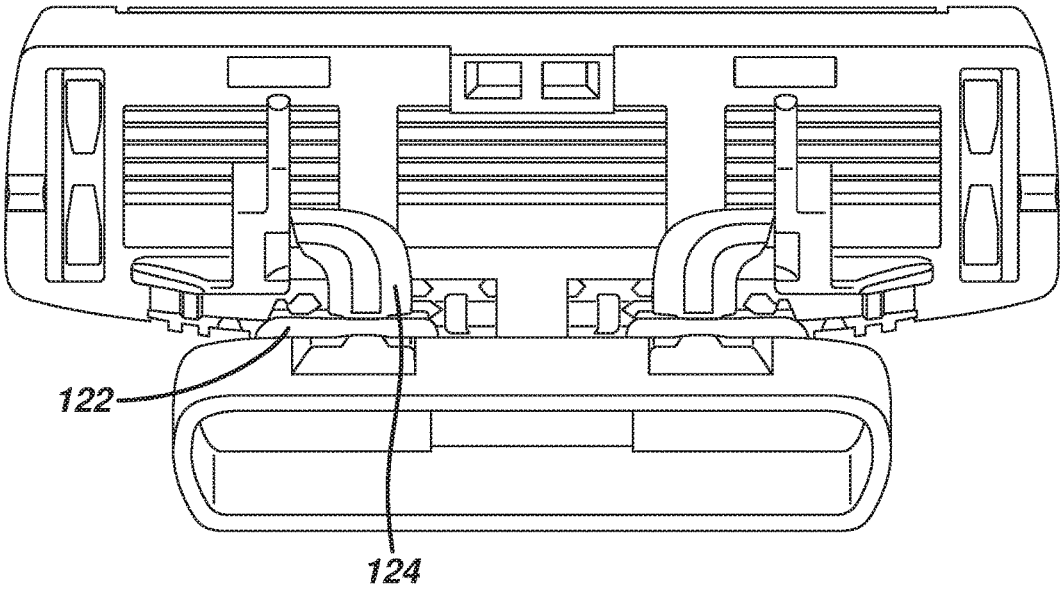
FIG. 8 is a perspective view of a replaceable shaving assembly including the blade unit, elastomeric portion, and interface element of the razor of FIG. 7.
Figure 9:
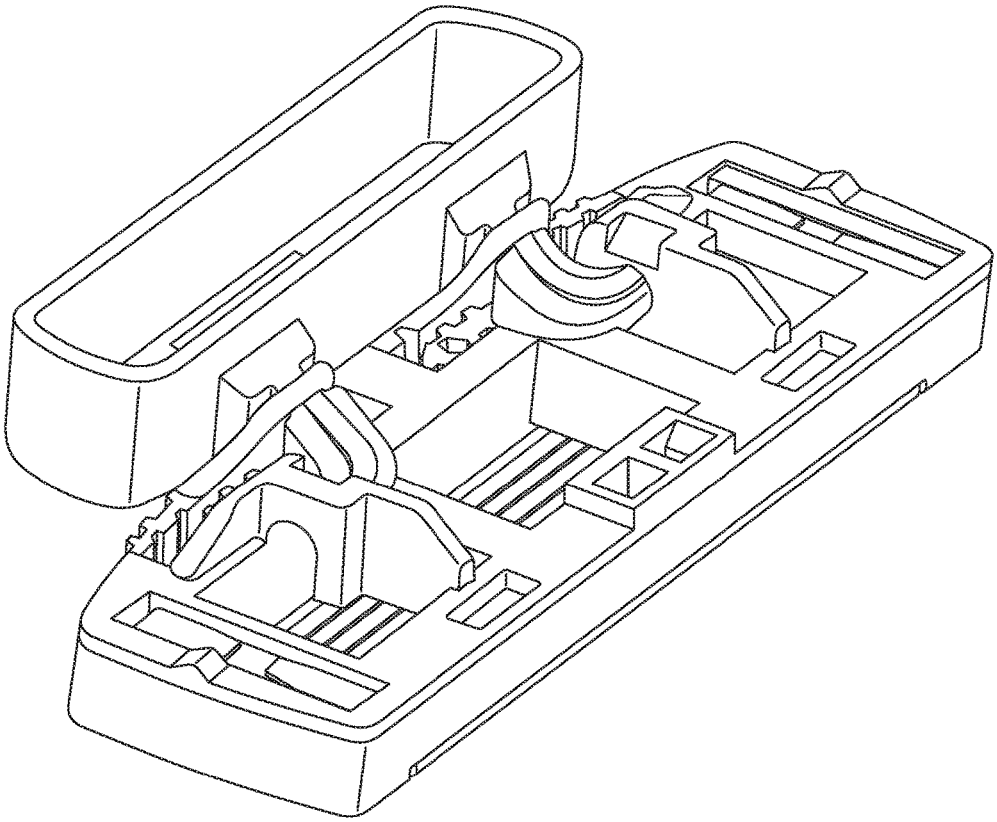
FIG. 9 is a perspective view of the shaving assembly of FIG. 8 viewed from a different angle.
Figure 10:
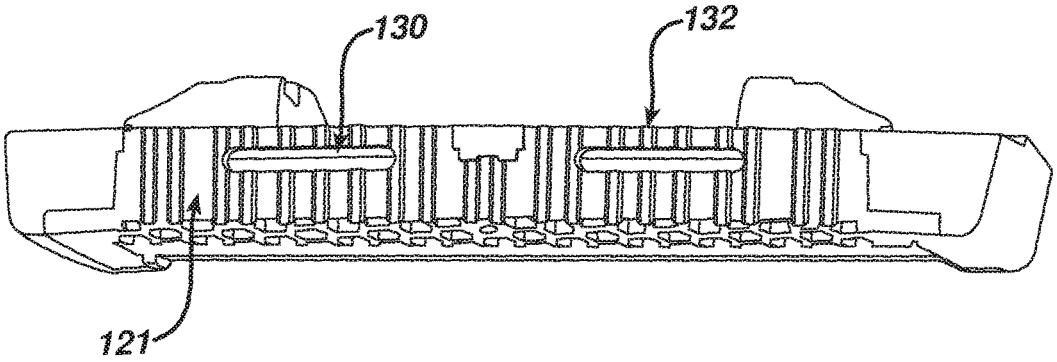
FIG. 10 is a perspective view of the blade unit and elastomeric portion of the razor of FIG. 7.
Figure 11:
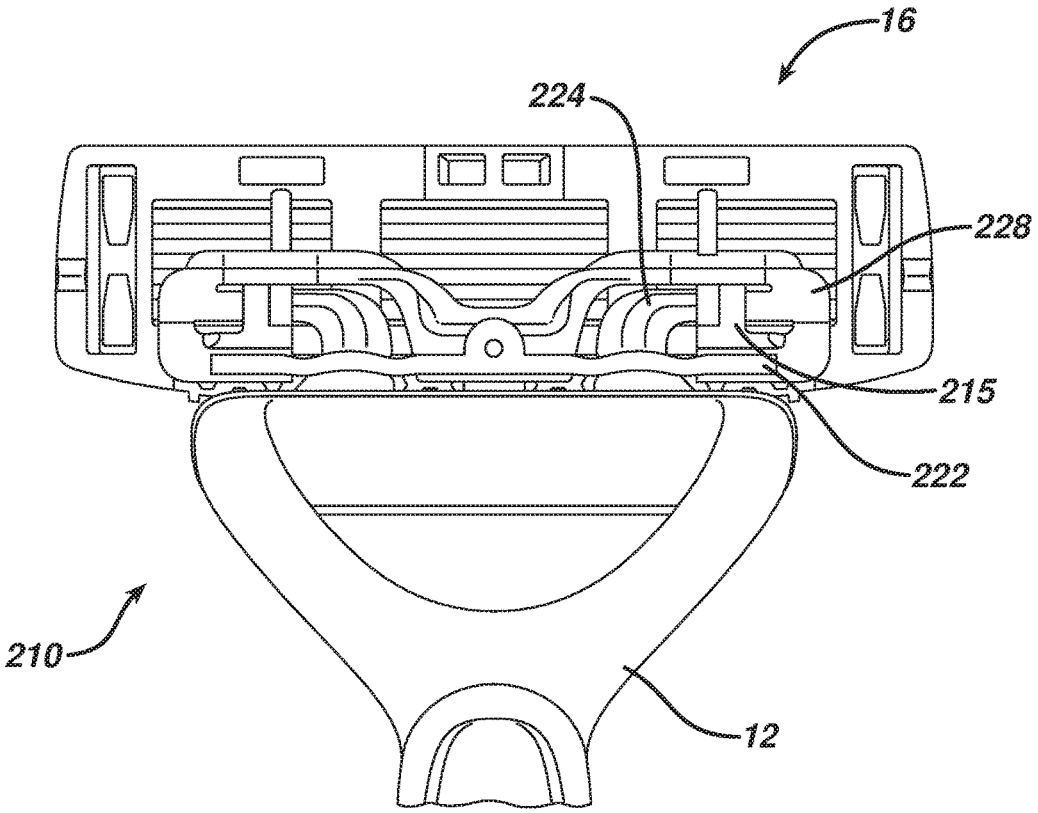
FIG. 11 is a top view of an alternate embodiment the shaving system.
Figure 12:
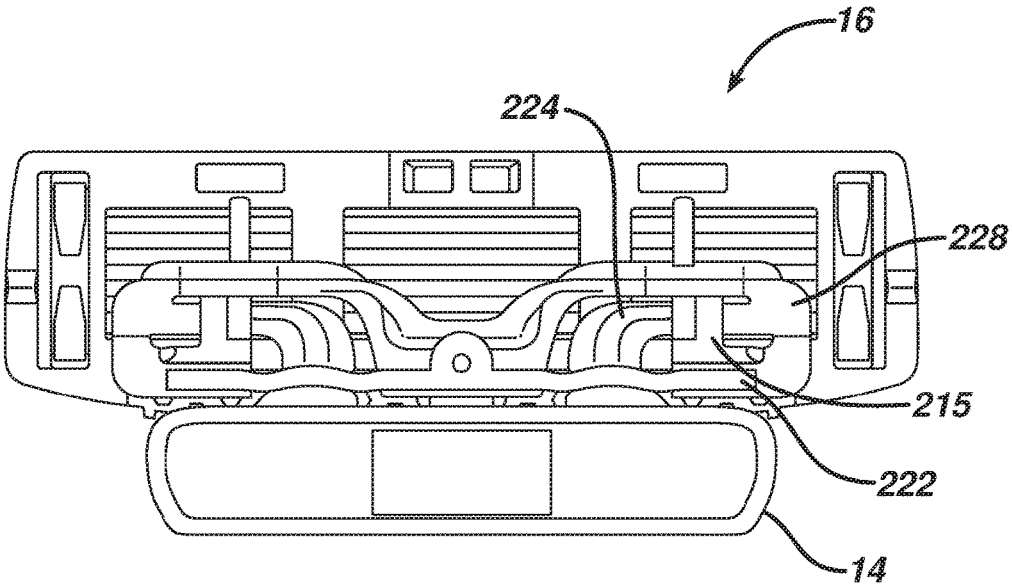
FIG. 12 is a top view of the shaving system of FIG. 11 viewed without the handle.
Figure 13:
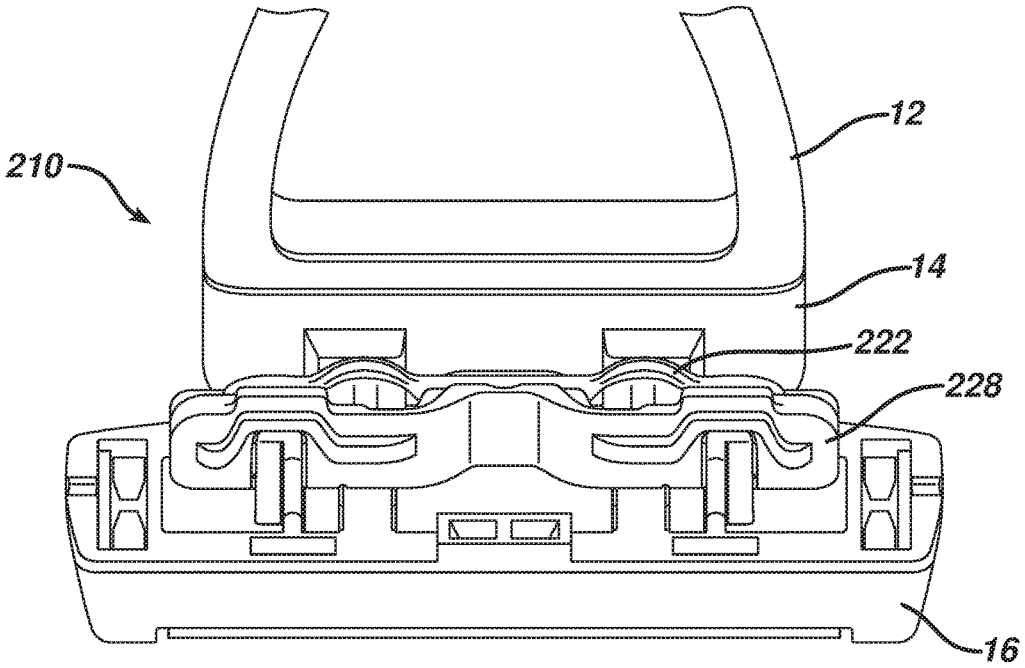
FIG. 13 is a front view of the shaving system of FIG. 11.
Figure 14:
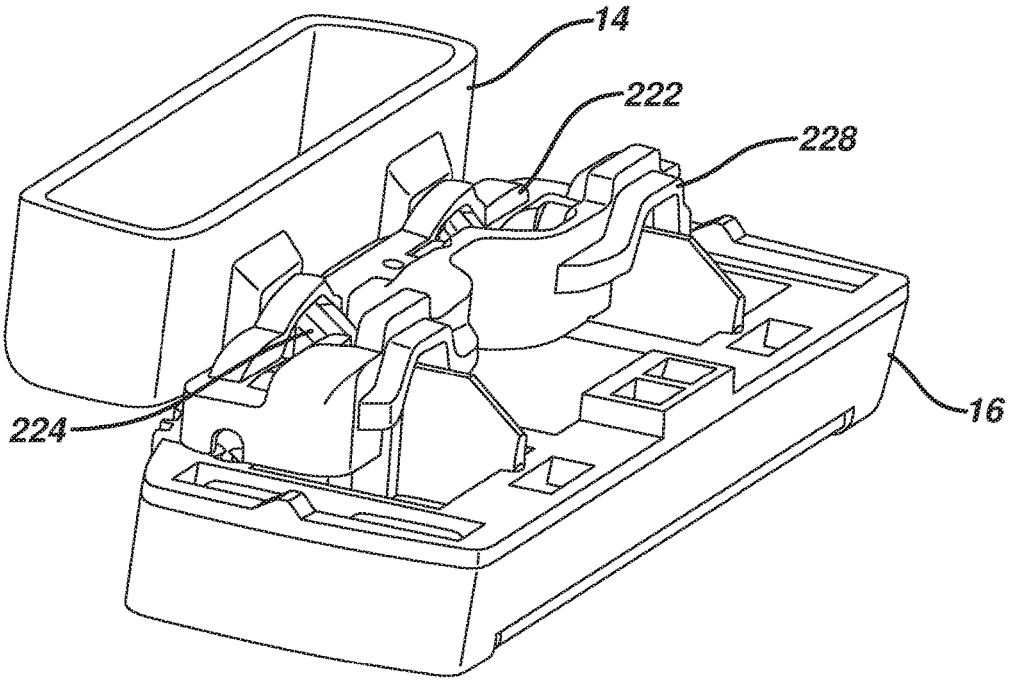
FIG. 14 is a perspective view of the shaving system of FIG. 11 viewed without the handle.
Figure 15:
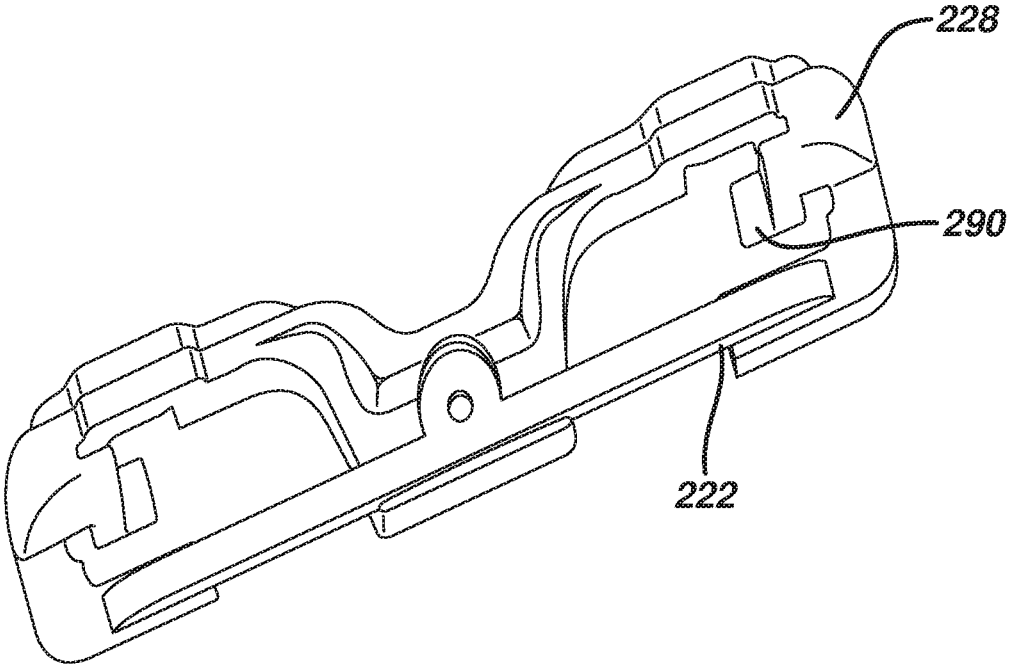
FIG. 15 is a perspective view of the blade unit interface element.

FIG. 4 shows the guard with loops 22 assembled onto the blade unit housing, prior to the arms and fingers of the interface element being threaded through the loops, while FIG. 5 shows an enlarged, detail view of the blade unit, showing the generally rectangular shape of the openings 23 in loops 22. FIG. 6 shows the replaceable shaving assembly, including the blade unit and interface element, as it would be viewed when attaching the shaving assembly to a handle.

FIGS. 7-10 show a shaving system 110 according to an alternate embodiment. In this embodiment, the loops 122 are thinner, in the form of a narrow web of material. In this embodiment, the arms 124 may include a pair of indentations, as shown, to better capture the thin loops.

The loops 122 can be formed, for example, by providing a guard 121 (FIG. 10) having a pair of elongated openings 130 which define webs 132. These webs lie flat against the blade unit housing as molded, but can be stretched to form loops 122 during assembly of the shaving assembly 110.

Figure 16:
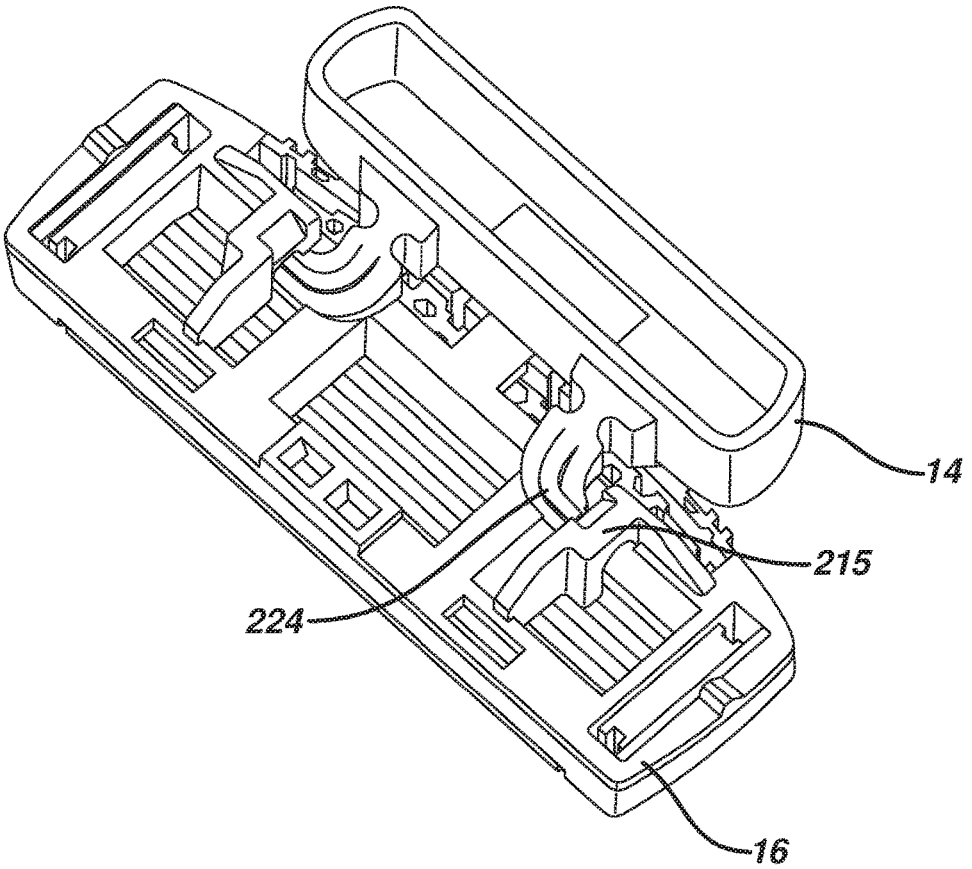
FIG. 16 is a perspective view of the blade unit and interface element with the blade unit interface element omitted.
Figure 17:
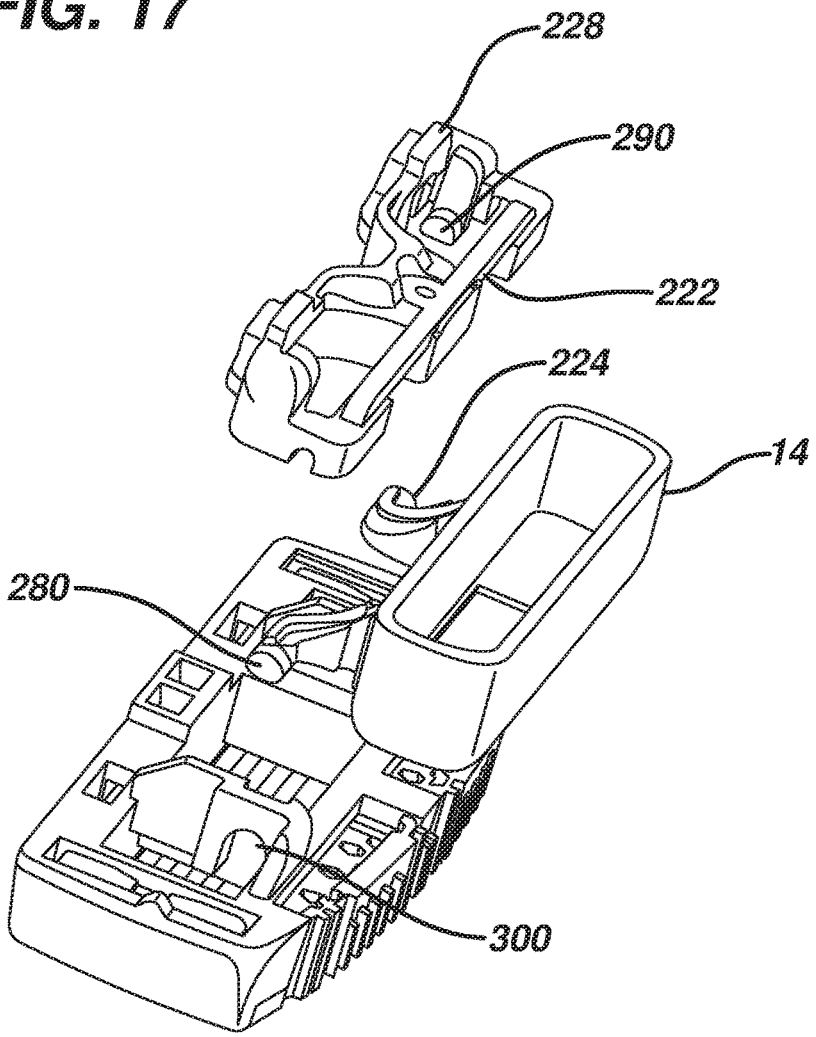
FIG. 17 is an exploded view of the blade unit, interface element, and the blade unit interface element.
Figure 18:
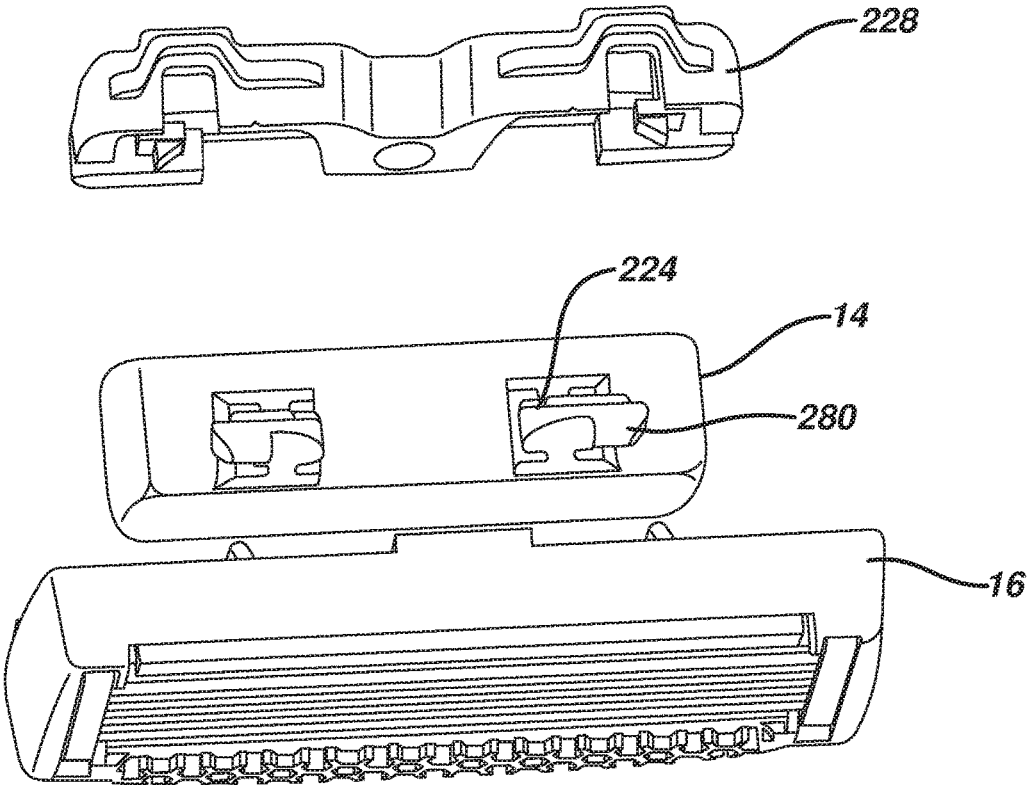
FIG. 18. is an exploded view of the blade unit, interface element and the blade unit interface element taken from a different angle.

FIGS. 11-18 show a shaving system 210 according to another alternate embodiment. In this embodiment, the elastomeric material 222 is attached to the blade unit interface element 228. The blade unit interface element 228 attaches to the blade unit 16 by utilizing protrusions 290 (FIG. 15) which are configured to interface with blade unit receiving bores 300 (FIG. 17).

The handle interface element 14 is configured to snap onto the blade unit interface element 228 during replacement of the shaving assembly. Referring to FIGS. 5, 16, and 17, two fingers 224 protrude from the handle interface element 14 and have curved surfaces 280, which clip into receiving bores on the blade unit 16. This interaction allows the blade unit 16 to articulate with respect the handle 12 along an axis that is generally perpendicular to the long axis of the handle.

In this alternate embodiment, the elastomeric material 222 can be co-molded with or attached to the blade unit interface element 228. The elastomeric material 222 extends over the handle interface protrusions 224 so that some tension is generated within the elastomeric material. This tension provides for proper resistive force necessary for shaving in the same manner discussed above with regard to the embodiments shown in FIGS. 1-10.

In all of the embodiments discussed above, the elastomeric element is designed such that its geometry provides an applied load as assembled that is sufficient to overcome the friction of the system at rest (pretensioned load), typically at least 5 grams, e.g., 5 to 40 grams, and a load during shaving of from about 30 to 110 grams.

Figure 19:
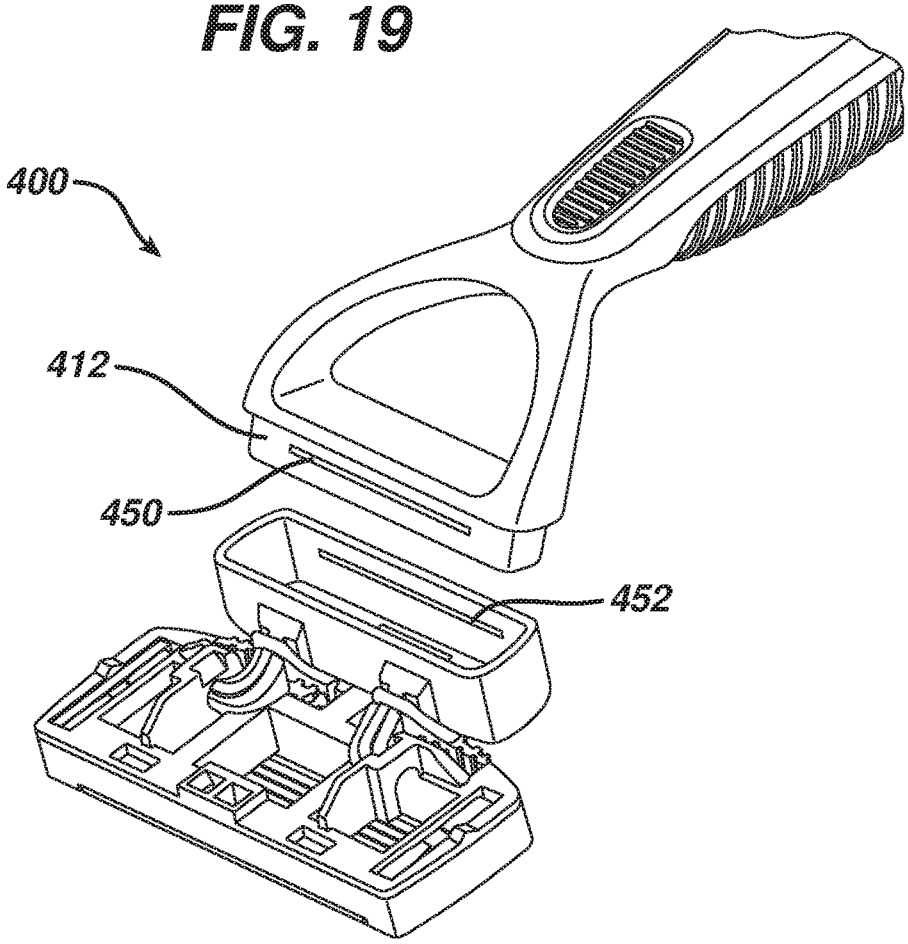
FIGS. 19-19A are perspective views of an embodiment in which the shaving assembly is designed to be permanently attached to the handle.
Figure 19A:
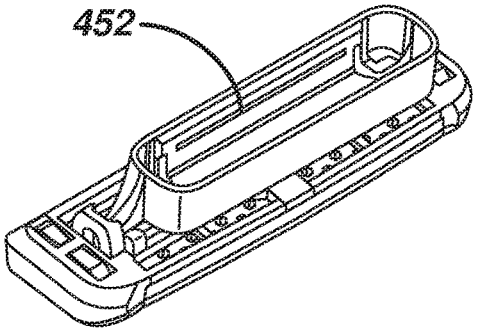

Also, while removable shaving assemblies have been discussed above, in some implementations the shaving system is designed to be disposable as a whole. In these cases, the shaving assembly is affixed to the handle in a manner that is not intended for the consumer to remove, e.g., by fixedly mounting the interface element on the distal end of the handle. This may be accomplished, for example, by engagement of corresponding mechanical locking features on the handle and interface element, by welding (e.g., ultrasonic welding), by molding the interface element integrally with the handle, or by any other desired mounting technique. An example of a disposable shaving system 400 is shown in FIG. 19, and the shaving assembly for such a system is shown in FIG. 19A. In this case, the handle 412 includes protrusions 450 (only one of which is shown, the other being on the opposite side of the handle), and the interface element includes corresponding locking indentations 452.

A number of embodiments have been described. Nevertheless, it will be understood that various modifications may be made without departing from the spirit and scope of the disclosure.

For example, the blade unit interface element could clip or snap onto the blade unit in any desired manner.

Moreover, the openings in loops 22 may have any desired shape that will receive corresponding features on the handle interface element.

In addition, while only one embodiment was shown configured to be disposable, any of the previously mentioned embodiments could also be configured to be disposable as well.

Accordingly, other embodiments are within the scope of the following claims.

What is claimed is:

1. A replaceable shaving assembly comprising:
a blade unit;
a handle interface element configured to removably connect the blade unit to a handle, on which the blade unit is pivotably mounted;
a blade unit interface element interposed between the handle interface element and the blade unit; and
an elastomeric return element carried by the blade unit interface element.

2. The replaceable shaving assembly of claim 1 wherein the blade unit interface element snaps onto the blade unit.

3. The replaceable shaving assembly of claim 1 wherein the blade unit interface element and blade unit include engaging features.

4. The replaceable shaving assembly of claim 3 wherein the blade unit interface element includes blade unit interface protrusions which are configured to interface with corresponding blade unit interface receiving bores on the blade unit.

5. The replaceable shaving assembly of claim 1 wherein the handle interface element includes handle interface protrusions that are received by corresponding handle interface receiving bores on the blade unit.

6. The replaceable shaving assembly of claim 5 wherein a portion of the elastomeric return element extends over the handle interface unit protrusions so that tension is generated within the elastomeric element.

7. The replaceable shaving assembly of claim 5 wherein each of the handle interface protrusions includes a portion extending from the handle interface unit generally perpendicular to a length of the blade unit, and the elastomeric return element comprises a strip that extends across the portions and along the length of the blade unit.

8. The replaceable shaving assembly of claim 7 wherein each of the handle interface protrusions further includes a curved portion extending to a distal finger that engages the corresponding bore on the blade unit.

9. The shaving system of claim 1 wherein the handle interface element includes handle interface protrusions that are received by corresponding handle interface receiving bores on the blade unit.

10. The shaving system of claim 9 wherein a portion of the elastomeric return element extends over the handle interface unit protrusions so that tension is generated within the elastomeric element.

11. The shaving system of claim 9 wherein each of the handle interface protrusions includes a portion extending from the handle interface unit generally perpendicular to a length of the blade unit, and the elastomeric return element comprises a strip that extends across the portions and along the length of the blade unit.

12. The shaving system of claim 11 wherein each of the handle interface protrusions further includes a curved portion extending to a distal finger that engages the corresponding bore on the blade unit.

13. A shaving system comprising:
a handle;
a blade unit;
a handle interface element configured to connect the blade unit to the handle, on which the blade unit is pivotably mounted;
a blade unit interface element interposed between the handle interface element and the blade unit; and
an elastomeric return element carried by the blade unit interface element.

14. The shaving system of claim 13 wherein the blade unit interface element snaps onto the blade unit.

15. The shaving system of claim 13 wherein the blade unit interface element and blade unit include engaging features.

16. The shaving system of claim 15 wherein the blade unit interface element includes blade unit interface protrusions which are configured to interface with corresponding blade unit interface receiving bores on the blade unit.

17. A method of manufacturing a shaving assembly for a wet shaving razor, the method comprising:
providing a blade unit;
attaching to the blade unit a blade unit interface element that carries an elastomeric return element; and
mounting a handle interface element, configured to connect the blade unit to a handle, on the blade unit interface element.

18. The method of claim 17 wherein the blade unit interface element and attached blade unit are pivotably mounted on the handle interface element.

19. The method of claim 17 wherein attaching comprises snapping the blade unit interface element onto a housing of the blade unit.

20. The method of claim 19 wherein the blade unit interface element includes blade unit interface protrusions which are configured to interface with corresponding blade unit interface receiving bores on the blade unit.

* * * * *